US006155737A

United States Patent [19]

Whaley

[11] Patent Number: 6,155,737

[45] Date of Patent: Dec. 5, 2000

[54] BOLT ACTION RING BINDER

[75] Inventor: Paul A. Whaley, County of Jefferson, Mo.

[73] Assignee: U. S. Ring Binder Corporation, New Bedford, Mass.

[21] Appl. No.: 09/302,283

[22] Filed: Apr. 30, 1999

[51] Int. Cl.[7] ..... B42F 3/02; B42F 13/22

[52] U.S. Cl. ..... 402/5; 281/27.1; 402/46; 402/49; 402/54; 402/56; 402/60; 402/61; 402/64

[58] Field of Search ..... 281/27.1; 402/46, 402/49, 54, 56, 60, 61, 64, 5

[56] References Cited

U.S. PATENT DOCUMENTS 3,255,759 6/1966 Dennis ..... 402/34

*Primary Examiner*—Andrea L. Pitts
*Assistant Examiner*—Mark T. Henderson
*Attorney, Agent, or Firm*—Polster, Lieder, Woodruff & Lucchesi, L.C.

[57] ABSTRACT

A binder ring mechanism (16) has a plurality of binder rings (18*a*–18*c*) for holding sheets of paper. Each binder ring includes a fixed section (20) and a movable section (22). All of the movable binder ring sections are commonly mounted on a bolt (36). A lever arm (52) is attached to one end of the bolt for movement of the lever arm to move the bolt and the binder ring sections mounted on the bolt. The bolt is movably mounted on a cover piece (24) for both rotational and sliding movement of the bolt. A recess (58) is formed in an endwall (56) of the cover piece and the lever arm includes a latch member (60) received in the recess to latch the lever arm in place when the binder rings are closed so to prevent inadvertent movement of the lever arm which might cause the binder rings to open. In addition, the cover piece has flaps (82, 84) extending diagonally outwardly therefrom for storing writing instruments in a ring binder (10) in which the binder ring mechanism is installed.

15 Claims, 4 Drawing Sheets

BOLT ACTION RING BINDER

CROSS-REFERENCE TO RELATED APPLICATIONS

This application is related to U.S. patent application Ser. No. 08/991,165 filed Dec. 16, 1997.

STATEMENT REGARDING FEDERALLY SPONSORED RESEARCH OR DEVELOPMENT

Not applicable.

BACKGROUND OF THE INVENTION

This invention relates to bolt action ring binders as described in the above referenced United States patent application, and more particularly, to improvements in such a ring binder.

Most ring binders employ some type of lever mechanism which is manually operable by the user of the binder to move pull the ring sections apart. While the lever mechanism is also operable to push the sections together, most people simply close the rings by exerting finger pressure on the two sections. Many people also open the binder rings by pulling them apart with their fingers.

In the referenced copending application, a bolt action ring binder is described. The bolt action mechanism replaces conventional binder ring metals employing a lever operated set of binder rings by which hole punched sheets of paper are stored in a binder. As noted in this application, the volume of paper sometimes stored in this binders is sometimes so great as to cause the rings to become partially spread apart when it is intended that the binder be fully closed. In such circumstances, it is not uncommon that even a slight additional pressure will cause the rings to open and paper to spill out. The bolt action ring metal is advantageous in that it effectively maintains a binder closed and is not susceptible to the occurrence of spills. Also, unlike prior art release mechanisms which use levers and the like, the bolt action ring binder employs a simple, easy to use, fail safe lever mechanism.

This application addresses improvements to a bolt action ring binder which facilitates assembly of the binder, prevents inadvertent release of the bolt mechanism by which the binder rings are opened and closed, and which provides storage for pens and pencils used by a person carrying the binder.

BRIEF SUMMARY OF THE INVENTION

Among the several objects of the present invention may be noted the provision of a bolt action ring binder for use in holding hole punched sheets of paper and the like;

- the provision of such a ring binder in which a bolt on which movable portions of binder rings are formed can be snap fitted onto the underside of a cover piece for ease of assembly of the bolt to a cover portion of a binder ring mechanism of the binder;
- the provision of such a ring binder in which the bolt, once fitted in place, is readily movable longitudinally and rotatably with respect to the cover;
- the provision of such a ring binder having a lever arm attached to one end of the bolt for rotating the bolt, the cover having a recess formed in one end thereof adjacent the lever arm for latchably receiving the lever arm to lock the lever arm in place with the binder rings closed so to prevent inadvertent rotation of the bolt and opening of the binder rings;

- the provision of such a binder ring mechanism to hold a pen or pencil in place for the writing instrument to be readily carried with the binder and not fall out regardless of how the binder is held;
- the provision of such a ring binder to be available in different sizes and to have different numbers of binder rings; and,
- the provision of such a mechanism which operates easily and reliably.

In accordance with the invention, generally stated, a ring binder stores hole punched sheets of paper. The binder includes first and second end leafs respectively forming outer covers of the binder. A binder ring mechanism has a plurality of binder rings which hold the sheets in their stored position and each binder ring includes a fixed section and a movable section. The mechanism further includes a movable bolt on which all of the movable binder ring sections are commonly mounted so to move in unison with the bolt. An improvement comprises a lever arm attached to one end of the bolt for movement of the lever arm to move the bolt and the binder ring sections mounted on the bolt. The bolt is movably mounted on a cover piece for both rotational and sliding movement of the bolt. A recess is formed in an endwall of the cover piece and the lever arm includes a latch member received in this recess to latch the lever arm in place when the binder rings are closed so to prevent inadvertent movement of the bolt which might cause the binder rings to open. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
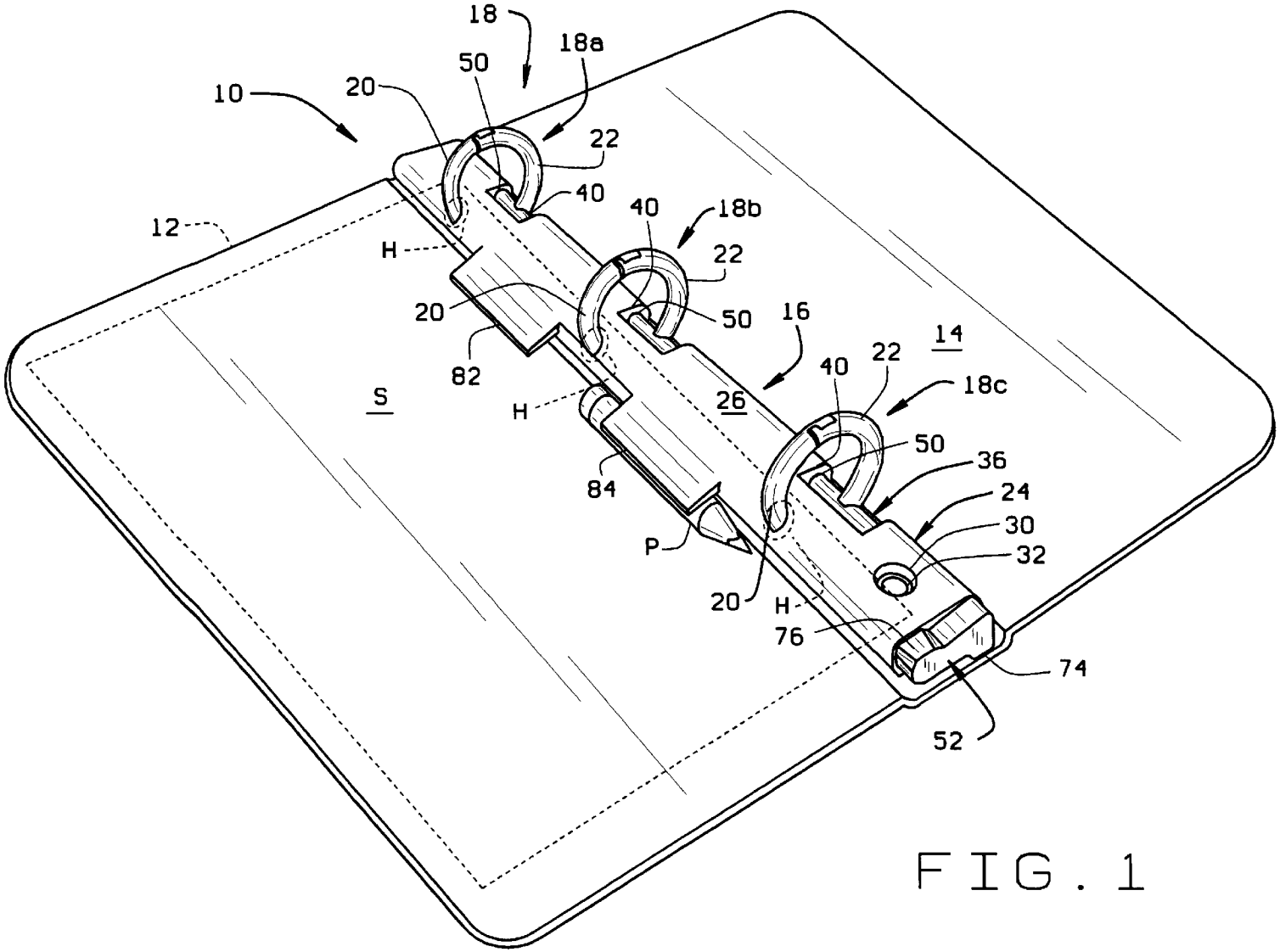
FIG. 1 is perspective view of a ring binder of the present invention.

Referring to the drawings, a ring binder of the present invention is indicated generally 10 and stores sheets S of paper having punched holes H in them. Binder 10 includes first and second end leafs 12, 14 respectively forming outer covers of the binder. The leafs are generally rectangular in shape and may be made of any suitable material. The length and width of the leafs are a function of the size of paper a particular binder 10 is intended to store. Next, a binder ring mechanism indicated generally 16 is positioned intermediate the respective end leafs, and the inner end of each end leaf is attached to the binder ring unit as described hereinafter.

Heretofore, instead of mechanism 16, a ring metal comprising an elongate or rectangularly shaped metal plate (not shown) has been used with the end leafs attached to the center plate and the center plate, in turn, attached to a spine portion of the binder by rivets or the like. Binder rings (also not shown) used with the ring metal have been two piece rings each of which is separately movable to open and close the binder.

Figure 3:
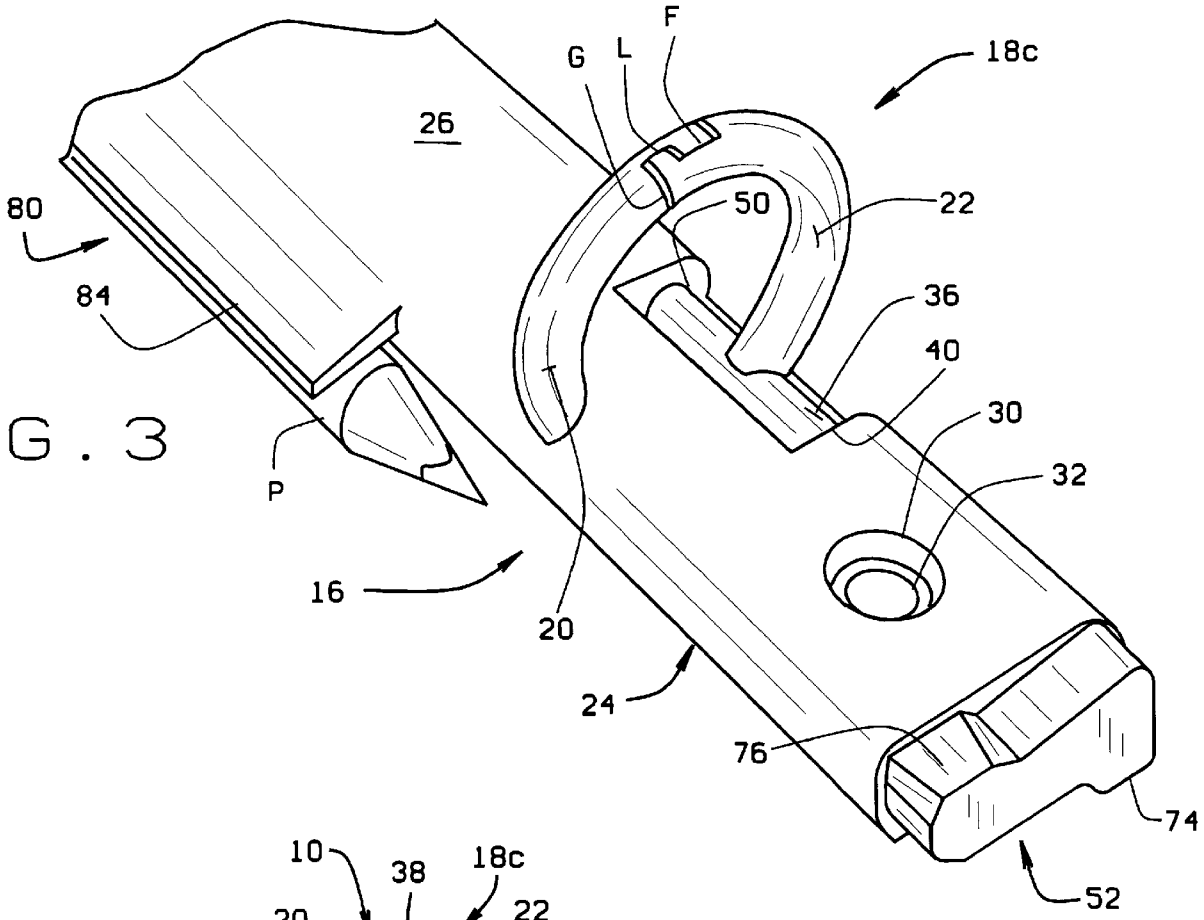
FIG. 3 is an enlarged broken away perspective view of the bolt action mechanism of the binder for holding hole punched sheets of paper in place.
Figure 2:
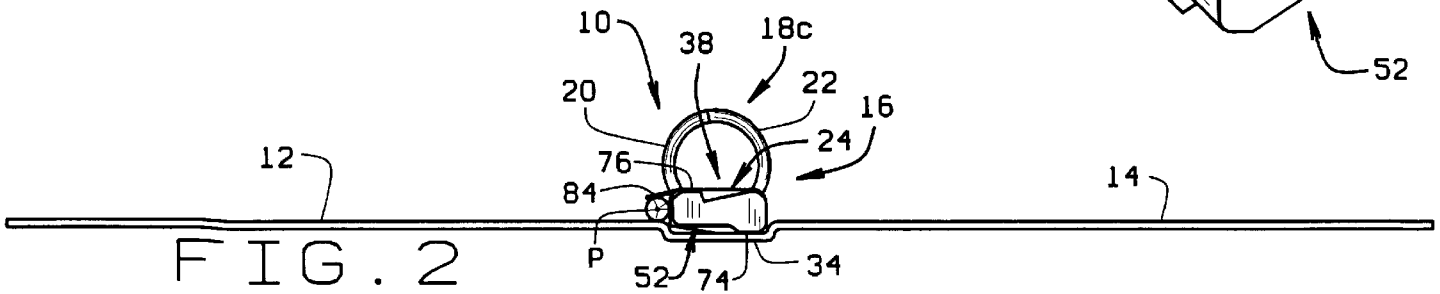
FIG. 2 is an end elevational view of the binder.
Figure 4:
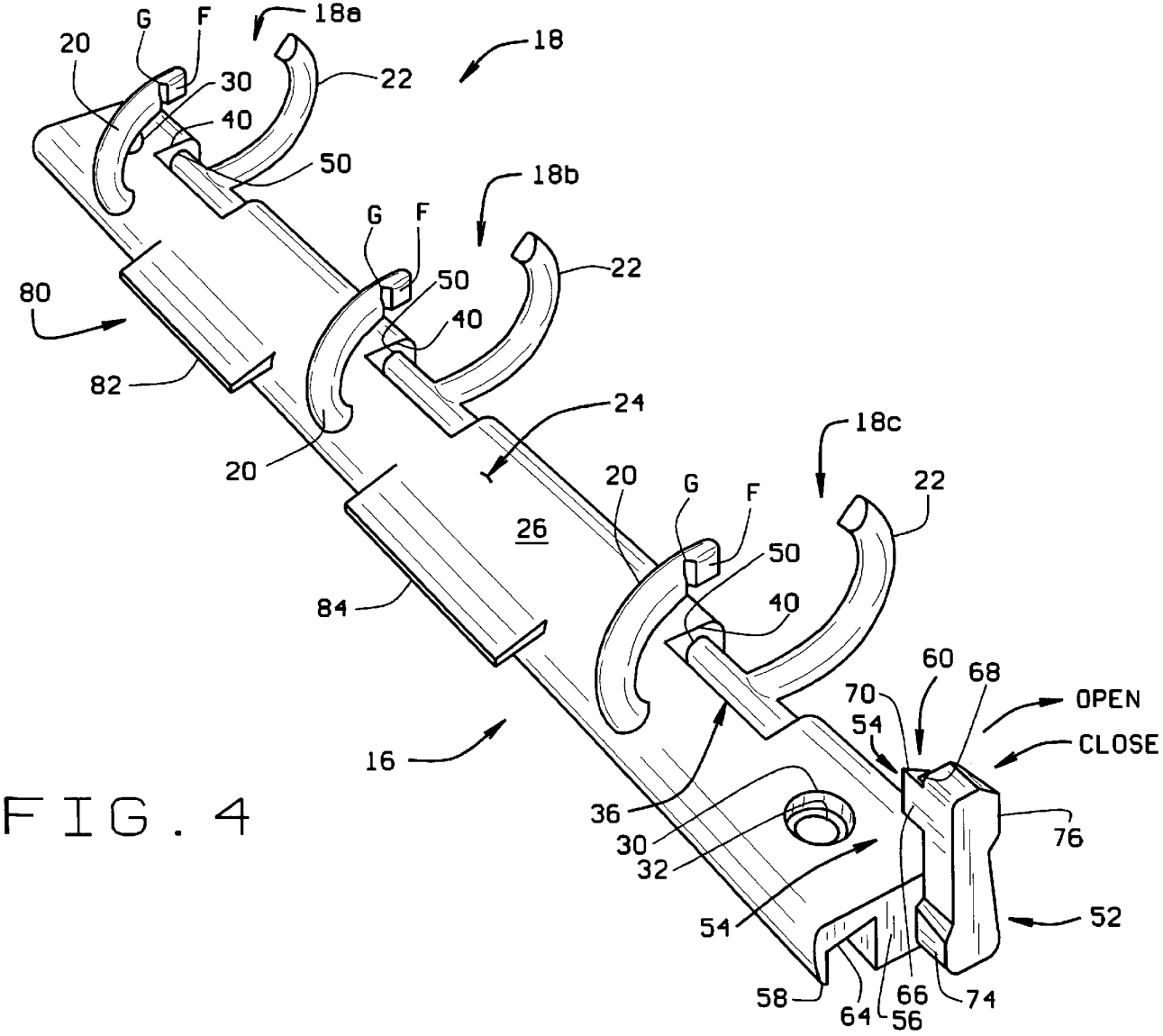
FIG. 4 is a perspective view of the mechanism in its binder open position.

Mechanism 16 first includes a plurality of binder rings 18 which hold the sheets S in their stored position. In the drawings, three binder rings 18*a*–18*c* are shown. It will be understood by those skilled in the art that binder 10 may have more, or fewer, binder rings 18 without departing from the scope of the invention. Regardless of the number of binder rings a binder may have, each binder ring has fixed section 20 and a movable section 22. As described hereinafter, ring binder mechanism 16 positively locks the binder ring sections together to hold the sheets in their stored position against forces tending to open said binder rings. As shown in FIGS. 3 and 4, fixed section 20 of each binder ring has a flat portion F formed adjacent its distal end, and a groove G formed at the inner end of the flat. Movable section 22 has a lip L which fits into groove G when the sections are brought together to close the binder. That is, the outer ends of the fixed and movable binder ring sections interlock with each other as shown in the drawings.

Mechanism 16 includes a cover piece or housing 24 the length of which is somewhat less than the height of binder 10 for reasons described hereinafter. The housing, which may of a molded plastic material or a metal stamping, has a top surface 26. Fixed sections 20 of the binder rings 18 are affixed to this top surface. The fixed ring sections 20 may be integrally formed with a housing projection (not shown) by which the ring section is fitted into one of a series of spaced openings 28 (see FIG. 5) formed in the top of the housing and extending along one side of the housing. The ring sections 20 are uniformly spaced along the top of the housing. Also formed in top surface 26 of the housing, at each end of the housing, is a recess 30. A rivet (not shown) is inserted through an opening 32 in recess 30 for attaching the housing to a spine portion 34 of the binder.

A bolt 36 can be mounted in housing 24 in a number of different ways. As shown in the drawings, housing 24 has a plurality of insets 40 formed along its side opposite the side where the fixed sections 20 of the binder rings are attached to, or formed with, the top of the housing. Bolt 36 has sections extending through these insets, these bolts sections being external of the housing. It is on these sections of bolt 36 where the movable portions 22 of the binder rings 18 are formed on the bolt, or are attached to the bolt.

Figure 6:
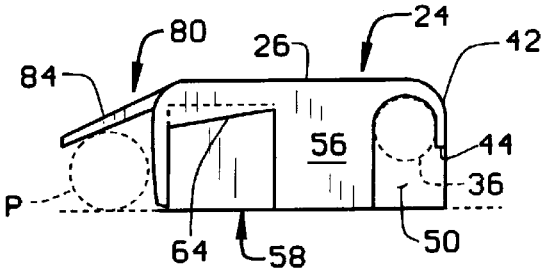
FIG. 6 is an elevational view of the end of the housing in which the bolt end of the bolt action mechanism is latched; and, FIGS. 7A–7C are respective top plan, end elevational, and bottom plan views of the bolt portion of the mechanism.
Figure 7A:
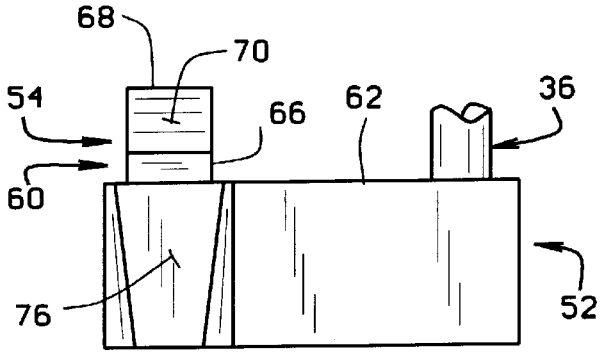
Figure 7B:
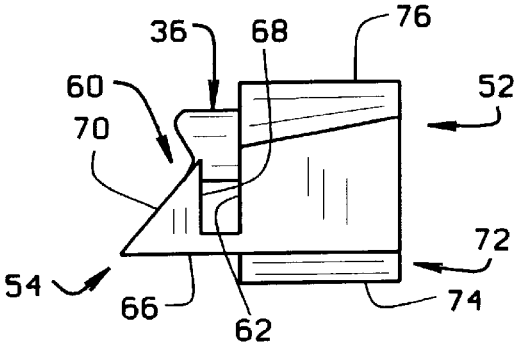
Figure 7C:
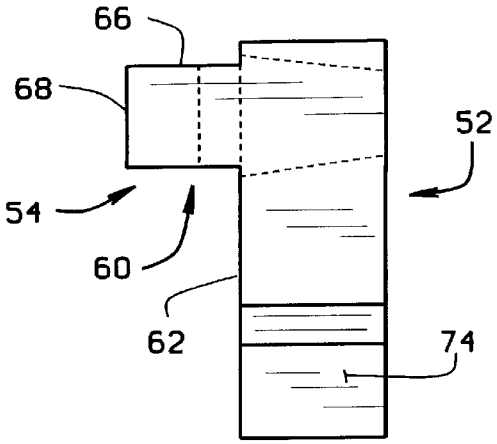
Figure 5:
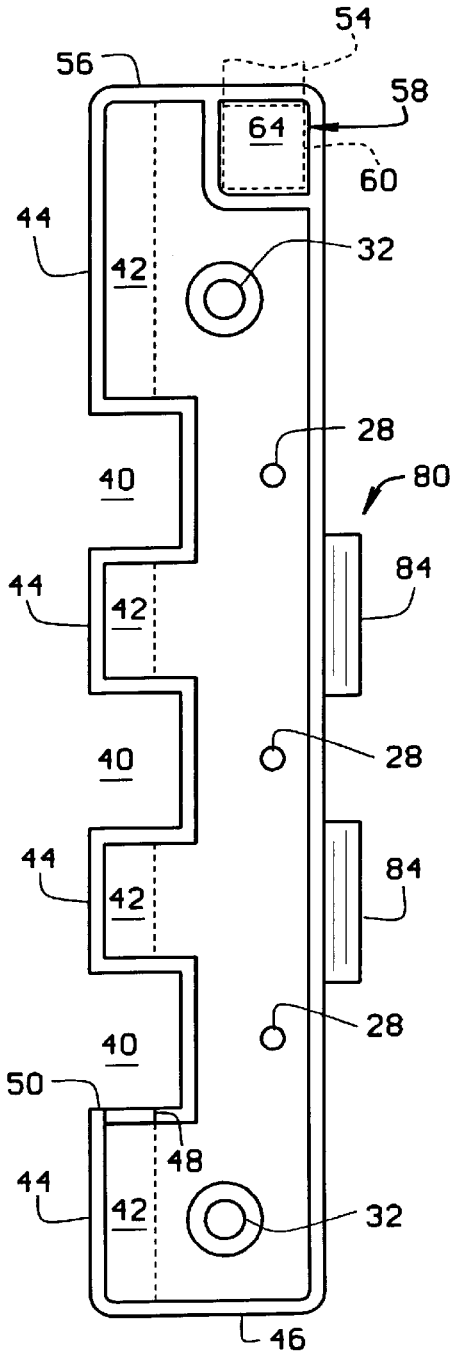
FIG. 5 is a bottom plan view of a housing of the binder ring mechanism.

Referring to FIGS. 5 and 6, housing 24 is shown to have an overhanging lip 42 formed on the side of the cover opposite the side on which the fixed sections of the binder rings are located. Lip 42 extends the length of the cover except for those sections where the insets 40 are formed. The outer margin 44 of the lip curves slightly inward. The lip defines an opening for bolt 36 to be mounted to the binder ring assembly. The inset 40 adjacent one end 46 of the housing has an opening 48, the diameter of which corresponds to the diameter of bolt 36, formed in a sidewall 50 of the inset. One end of the bolt is slidably received in this recess. The shaft of the bolt is now snap fitted into place using lip 42 to secure the bolt to the housing. The end of the bolt inserted through opening 48 is freely movable longitudinally of the housing so the bolt can move back and forth as is described hereinafter.

Bolt 36 has a lever arm 52 at its end opposite that inserted through opening 50. If the bolt is made of plastic, the lever arm is integrally molded with the shaft to form a one-piece unit. Otherwise, the lever is secured to the end of the bolt by threading the end of the bolt and screwing the lever arm on, pinning or welding it on, etc. The width of the lever arm is such that the combined length of housing 24 and the width of the lever arm generally correspond to the height of binder 10. A user of the binder manipulates the bolt using the lever arm. In use, when the binder is closed, the user first moves the bolt longitudinally to disengage the movable section 22 of the binder rings 18 from the fixed sections 20 thereof. Then, the user rotates the bolt clockwise from its position shown in FIG. 3 to its position shown in FIG. 4 to move the sections 22 clear of the sections 20. This is done so papers can be readily removed from, or inserted into, the binder. When the binder is to be closed, the steps are reversed.

It is an improvement of the present invention to provide a latching means 54 for latching lever arm 52 to an endwall 56 of cover piece 24. This is done so bolt 36 can be locked in place when binder rings 18 are closed thus preventing inadvertent movement of the lever arm which might cause the binder rings to open. A recess 58 is formed in endwall 56 and latching means 54 is received in the recess to latch the lever arm in place. For this purpose, latching means 54 includes a projection 60 formed on an inner face 62 of lever arm 52. The projection thus extends toward the endwall and into the recess formed therein.

Recess 58 has an upper wall surface 64, the wall sloping upwardly from the outer to the inner end of the recess. Projection 60 has a base portion 66 which is formed at the base of inner wall 62 of the lever arm and extends towards the recess therefrom. A tab 68 extends upwardly from the outer end of base 66. The tab has a sloping surface 70 which engages upper wall surface 64 of the recess. That is, the slope of surface 70 is complimentary to that of upper wall surface 64 so when projection 60 is inserted into the recess, the abutting surfaces prevent the lever arm from being disengaged from housing 24, effectively locking the binder rings 18 in their closed positions. Further, the quality of the engagement is such that the lever arm will not be dislodged from the recess even when the ring binder is subjected to violent forces such as occur when the binder is dropped from a height or thrown against a hard surface.

While insertion of projection 60 into recess 58 securely locks the binder rings in their closed position, lever arm 52 further includes means 72 for readily releasing the projection from the recess so bolt 36 is freed for movement to open the binder rings. As shown in the drawings, projection 60 is formed at one end of lever arm 52. The lever arm attaches to the bolt at its other end. Release means 72 first includes a lug 74 extending beneath the base of the lever arm at the bolt connection end of the lever arm. The lug bears against a spine portion of the binder when the lever is captured in recess 58. Because the bolt acts as a pivot about which the lever arm rotates, the lug serves to bias the lever arm in a clockwise direction (as viewed in the drawings) so to maintain projection 60 in its latched position within recess 58. The release means further includes a finger pad 76 formed on the top surface of the lever arm immediately above projection 60. Depressing finger pad 76 rocks the lever arm in a counter-clockwise direction so to move surface 70 of tab 68 out of contact with wall surface 64 of the recess. Because of the sloping surface of the tab, the movement away from surface 64 also creates a "spring-like" action which moves bolt 36 longitudinally.

Finally, it is a feature of the improvement of the present invention to provide a binder ring assembly by which writing instruments P (see FIGS. 1, 3, and 6) such as pens and pencils can be securely stored in the binder. For this purpose a storage means 80 is formed on housing 24. The storage means includes one, and preferably two spaced flaps 82, 84 formed on top surface 26 of the housing and extending outwardly, and in a generally diagonally downward direction, to one side of the housing. The flaps secure a pen or pencil between a flap and an inner face of the binder cover to hold the writing instrument in place. For this purpose, the flaps are sufficiently rigid to press the pen or pencil against the binder ring cover with enough force to keep the instrument in place while the binder is being moved. At the same time, the flaps are sufficiently flexible so that the pen or pencil is readily retrieved when needed for use.

What has been described is an improvement to a ring binder assembly employing a bolt action mechanism for opening and closing binder rings on which paper and the like is stored. The assembly includes a cover piece in which a recess is formed at one end and the bolt has an attached lever arm including a projection which, when inserted in the recess locks the bolt in place and prevents inadvertent opening of the binder rings. In addition, the cover piece includes a lip extending along one side into which the bolt snap fits for ease of assembly and operation of the bolt. Finally, the cover piece includes integrally formed flap pieces by which pens, pencils and the like can be conveniently stored when not being used.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In a ring binder storing hole punched sheets of paper, the ring binder having first and second end leafs respectively forming outer covers of the binder, a plurality of binder rings which hold the sheets in their stored position, each binder ring including a fixed section and a movable section, and a movable bolt on which all of said movable binder ring sections are commonly mounted so to move in unison with the bolt, the improvement comprising:

a lever arm attached to one end of said bolt for movement of said lever arm to move the bolt and the movable binder ring sections mounted thereon;

a cover piece to which said bolt is movably mounted for both rotational and sliding movement of said bolt; and, latching means formed on said lever arm for latching said lever arm to an endwall of said cover piece and locking said bolt in place when said binder rings are closed thereby to prevent inadvertent movement of the lever arm which might cause the binder rings to open, said latching means including a projection formed on a face of said lever arm adjacent said endwall of said cover piece and extending toward said endwall, and a recess being in said endwall for receiving said projection.

2. The improvement of claim 1 wherein said recess has an upper wall surface which is a sloping surface and said projection includes a tab having a sloping surface which engages said sloping upper wall surface.

3. The improvement of claim 2 wherein said lever arm further includes means urging said tab against said upper wall surface of said recess.

4. The improvement of claim 3 wherein said projection is formed at one end of said lever arm and a lug is formed on a base of the lever arm at the opposite end thereof said lug bearing against a portion of the binder when the lever is captured in said recess.

5. The improvement of claim 4 further including a finger pad formed on said lever arm above said projection for depressing said lever arm to release said tab from said recess and allow said bolt to be moved.

6. In a ring binder storing hole punched sheets of paper, the ring binder having first and second end leafs respectively forming outer covers of the binder, a plurality of binder rings which hold the sheets in their stored position, each binder ring including a fixed section and a movable section, and a movable bolt on which all of said movable binder ring sections are commonly mounted so to move in unison with the bolt, the improvement comprising:

a lever arm attached to one end of said bolt for movement of said lever arm to move the bolt and the movable binder ring sections mounted thereon;

a cover piece to which said bolt is movably mounted for both rotational and sliding movement of said bolt;

latching means formed on said lever arm for latching said lever arm to an endwall of said cover piece and locking said bolt in place when said binder rings are closed thereby to prevent inadvertent movement of the lever arm which might cause the binder rings to open;

attachment means formed an underside of said cover piece for movably securing said bolt to said cover piece; and, storage means by which a user of said ring binder can store a writing instrument in said ring binder.

7. The improvement of claim 6 wherein said attachment means includes a recess formed on said underside of said cover piece and extending from one end of the cover piece to the other end thereof, said bolt snap fitting into said recess so as to be positively mounted therein for both rotatable and longitudinal movement.

8. The improvement of claim 6 wherein said storage means includes a flap formed on said cover piece and extending outwardly to one side thereof, a writing instrument being securable between said flap and an inner face of said binder cover to hold said writing instrument in place.

9. The improvement of claim 8 wherein said storage means includes a pair of spaced flaps are formed on said cover piece on a side of said cover piece opposite that on which said bolt is secured to said cover piece, each flap accommodating a separate writing instrument.

10. A ring binder storing hole punched sheets of paper comprising:

first and second end leafs respectively forming outer covers of the binder;

a binder ring mechanism including a plurality of binder rings which hold the sheets in their stored position, each binder ring including a fixed section and a movable section, a movable bolt on which all of the movable binder ring sections are commonly mounted so to move in unison with the bolt, and a cover piece to which said bolt is movably mounted for both rotational and sliding movement of the bolt; and, a lever arm attached to one end of the bolt for movement of the lever arm to move the bolt and the binder ring sections mounted on the bolt, said cover piece having a recess formed in an endwall thereof, and the lever arm having a latch member received in said recess to latch the lever arm in place when the binder rings are closed so to prevent inadvertent movement of the lever arm which might cause the binder rings to open, said latch member including a projection formed on a face of said lever arm said endwall of said cover piece and extending toward said endwall, and said recess being formed in said endwall for receiving said projection.

11. The improvement of claim 10 wherein said recess has an upper wall surface which is a sloping surface and said projection includes a tab having a sloping surface which engages said sloping upper wall surface.

12. The ring binder of claim 11 wherein said lever arm further includes means urging said tab against said upper wall surface of said recess.

13. The ring binder of claim 12 wherein said projection is formed at one end of said lever arm and a lug is formed on a base of the lever arm at the opposite end thereof, said lug bearing against a portion of the binder when the lever is captured in said recess.

14. The ring binder of claim 13 further including a finger pad formed on said lever arm above said projection for depressing said lever arm to release said tab from said recess and allow said bolt to be moved.

15. A ring binder storing hole punched sheets of paper comprising:

first and second end leafs respectively forming outer covers of the binder;

a binder ring mechanism including a plurality of binder rings which hold the sheets in their stored position, each binder ring including a fixed section and a movable section, a movable bolt on which all of the movable binder ring sections are commonly mounted so to move in unison with the bolt, and a cover piece to which said bolt is movably mounted for both rotational and sliding movement of the bolt;

a lever arm attached to one end of the bolt for movement of the lever arm to move the bolt and the binder ring sections mounted on the bolt, said cover piece having a recess formed in an endwall thereof, and the lever arm having a latch member received in said recess to latch the lever arm in place when the binder rings are closed so to prevent inadvertent movement of the lever arm which might cause the binder rings to open;

attachment means formed an underside of said cover piece for movably securing said bolt to said cover piece, said attachment means including a recess formed on said underside of said cover piece and extending from one end of the cover piece to the other end thereof, said bolt snap fitting into said recess so as to be positively mounted therein for both rotatable and longitudinal movement; and, storage means by which a user of said ring binder can store a writing instrument in said ring binder and including a flap formed on said cover piece and extending outwardly to one side thereof, a writing instrument being securable between said flap and an inner face of said binder cover to hold said writing instrument in place.

* * * * *